United States Patent [19]

Difley et al.

[11] 4,109,571

[45] Aug. 29, 1978

[54] REFUSE COMPACTION METHOD

[75] Inventors: Charles Rogers Difley; William Roy McDonald, both of Danville, Ky.

[73] Assignee: Whirlpool Corporation, Benton Harbor, Mich.

[21] Appl. No.: 815,602

[22] Filed: Jul. 14, 1977

[51] Int. Cl.[2] ..... B30B 13/00

[52] U.S. Cl. ..... 100/35; 100/229 A; 220/449

[58] Field of Search ..... 100/35, 229 A; 53/124 B; 220/63 R, 65; 229/14 B, 14 BE, 14 BW; 232/43.2, 43.5; 248/99, 101; 141/316, 319, 73, 80

[56] References Cited

U.S. PATENT DOCUMENTS

| | | | |
|---|---|---|---|
| 1,488,203 | 3/1924 | Horne | 229/14 BE |
| 2,916,183 | 12/1959 | Ariens | 220/65 |
| 3,261,545 | 7/1966 | Frazier | 232/43.2 |
| 3,443,745 | 5/1969 | Kleeberg | 232/43.2 |
| 3,722,561 | 3/1973 | O'Leary | 141/316 |
| 3,762,599 | 10/1973 | Bourgeois | 220/63 R |
| 3,888,406 | 6/1975 | Nippes | 220/65 X |
| 3,917,107 | 11/1975 | Bottas | 220/65 |
| 3,937,355 | 2/1976 | Engebretsen | 220/63 R |

*Primary Examiner*—Billy J. Wilhite

*Attorney, Agent, or Firm*—Wegner, Stellman, McCord, Wiles & Wood

[57] ABSTRACT

A method of bagging refuse in a refuse compactor wherein the drawer of the compactor is provided with an upwardly opening bag having installed therein a plurality of sets of stacked paper sheets in lining relationship to the bag with an upper portion of the sheets turned over the turned-over top portion of the bag. The upper portion of the sheets and the top portion of the bag are secured to the upper edge portion of the drawer during the compacting operation. Upon completion of the compacting operation, the top portion of the bag is gathered with the refuse and lining sheets disposed fully within the bag so as to permit disposal of the compacted refuse in closed, bagged form.

10 Claims, 10 Drawing Figures

Fig. 1.
PRIOR ART
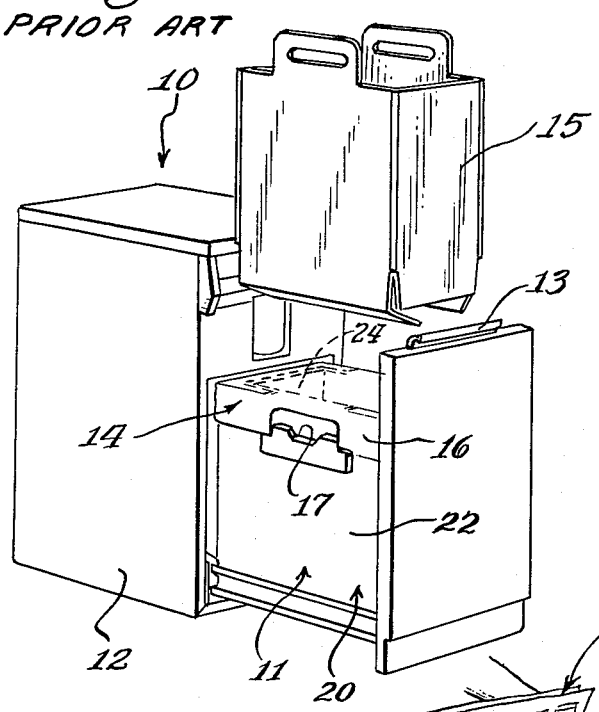
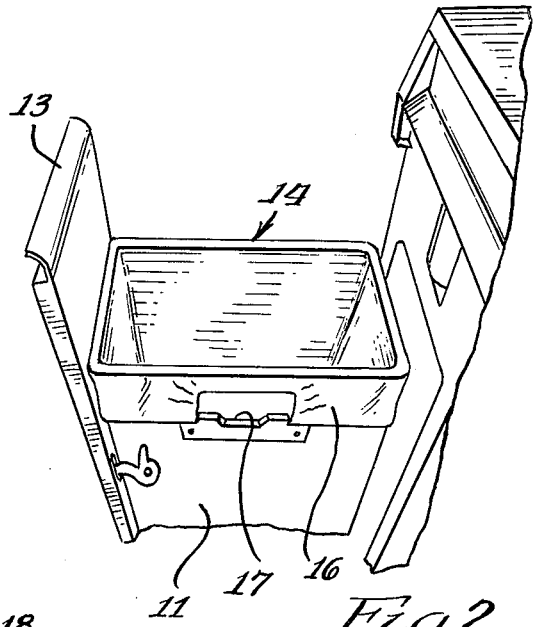
Fig. 2.
PRIOR ART
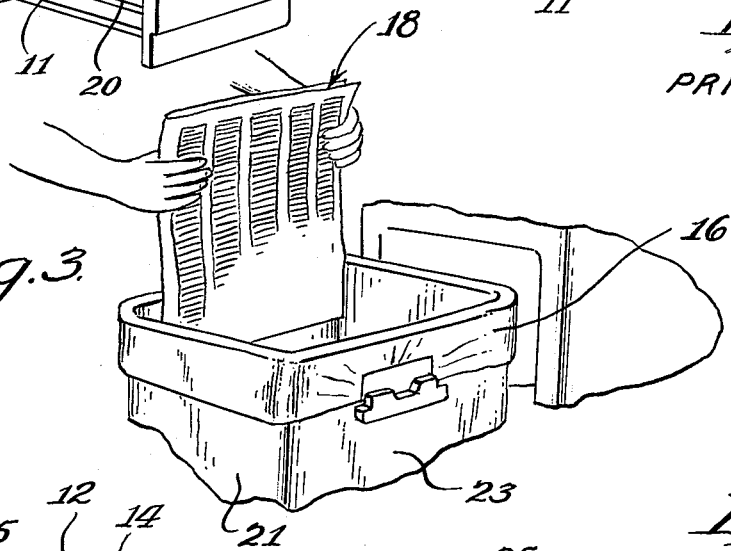
Fig. 3.
Fig. 4.
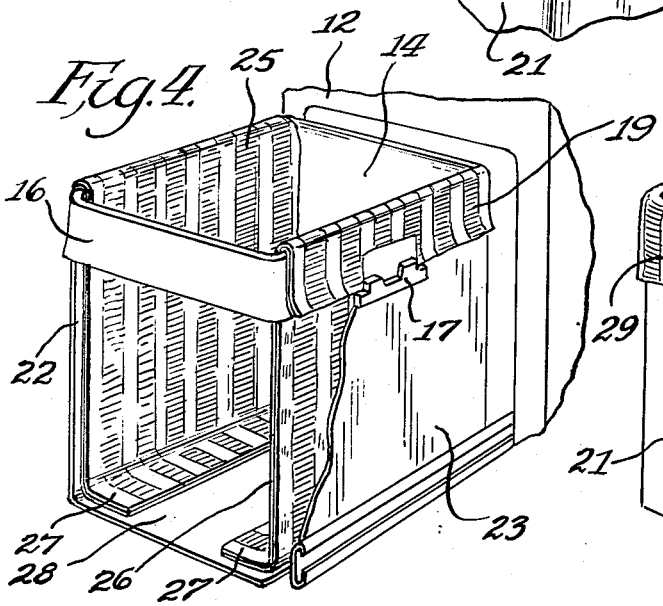
Fig. 5.
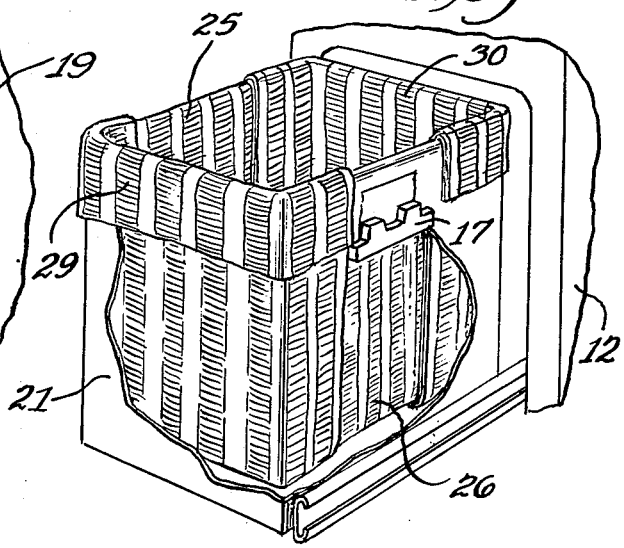

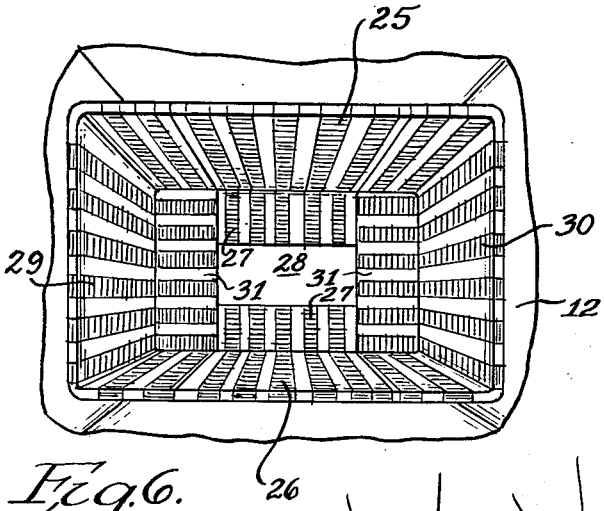
Fig.6.
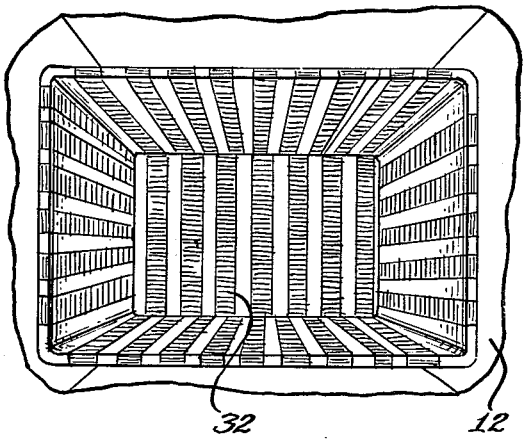
Fig.7.
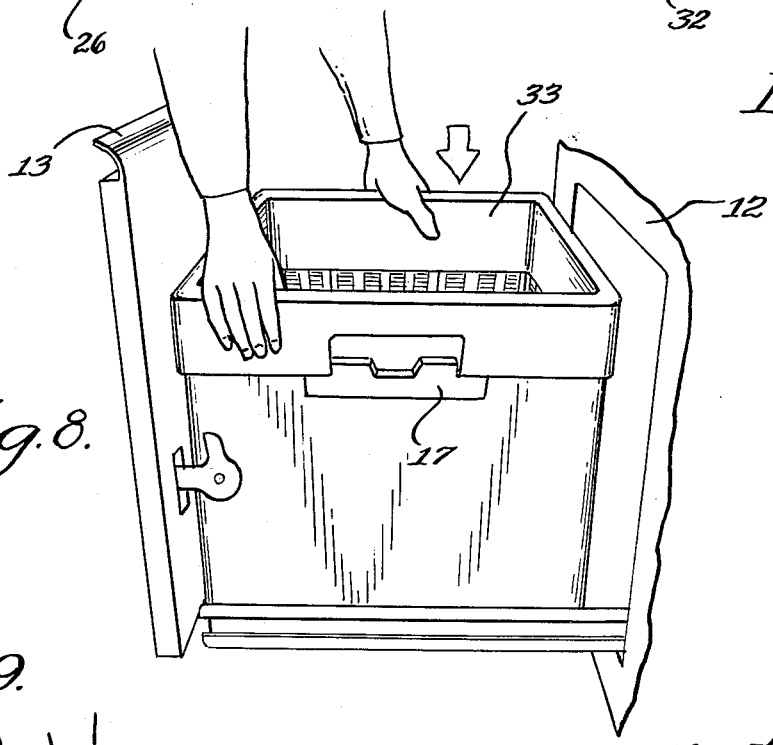
Fig.8.
Fig.9.
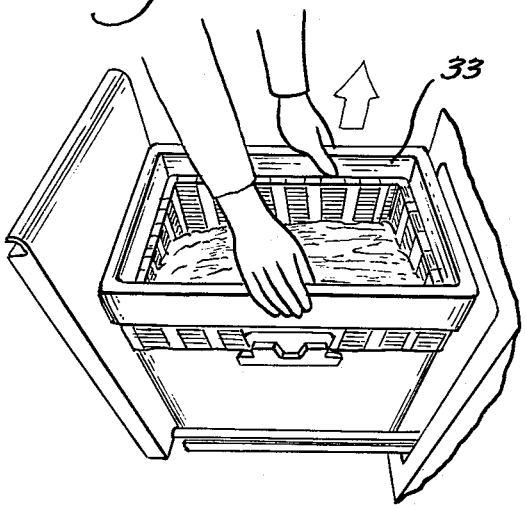
Fig.10.
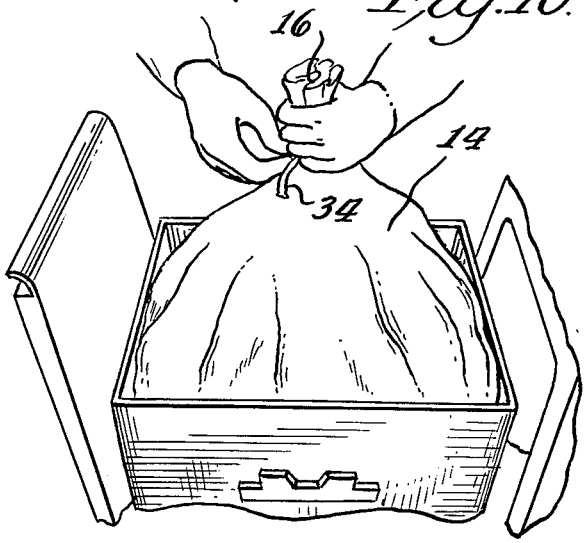

REFUSE COMPACTION METHOD

BACKGROUND OF THE INVENTION

1. Field of the Invention

This invention relates to the compaction of refuse and in particular to the compaction of refuse in relatively thin-walled, disposable bags.

2. Description of the Prior Art

In one improved form of refuse compactor illustrated in U.S. Pat. No. 3,917,107 of Michael J. Bottas et al, which patent is owned by the assignee hereof, a removable protective sleeve is provided within the relatively thin-walled, single ply plastic bag so as to maintain the integrity of the bag during the compacting operation. As disclosed therein, the sheath is preferably formed of a cut-resistant, tough material such as a suitable synthetic resin material.

Another form of support sleeve for use in a refuse compactor is illustrated in U.S. Pat. No. 3,722,561 of Timothy W. O'Leary et al. Therein, the support sleeve is provided with a rigid collar having a plurality of independently flexible wall portions. The sleeve is inserted into the flexible bag to maintain the mouth and body of the bag open for facilitated compaction.

Joseph F. Bourgeois discloses, in his U.S. Pat. No. 3,762,599, a trash compactor structure wherein a number of arcuate shield plates are placed about the sidewall of the container in which is nested a plastic liner and then a disposable plastic bag.

Einar O. Engebretsen shows, in U.S. Pat. No. 3,937,355, a removable liner for trash compactors comprising a two-piece structure. A plastic bag is installed within the liner and is secured at its upper edge to the top portion of the liner by suitable clips.

In each of U.S. Pat. Nos. 2,916,183 of Virgil C. Ariens, 3,261,545 of Michael E. Frazier, and 3,443,745 of Gunther K. E. Kleeberg, some form of collar is provided for use in retaining portions of the refuse receptacle.

SUMMARY OF THE INVENTION

The present invention comprehends an improved method of bagging refuse in a refuse compactor.

More specifically, the invention comprehends an improved method of bagging refuse in a refuse compactor having an upwardly opening compaction receptacle defining an upper edge portion, an upright sidewall, and a bottom wall, including the steps of installing an upwardly opening bag in the receptacle with a bottom portion superposed on the receptacle bottom wall, a sidewall portion juxtaposed to the receptacle sidewall, and a top portion turned over the receptacle upper edge portion; installing a plurality of sets of stacked paper sheets in lining relationship to the bag with an upper portion of the sheets turned over the turned-over top portion of the bag; securing the overlying upper portion of the sheets and top portion of the bag to the upper edge portion of the receptacle; subsequent to disposing refuse in the sheet-lined bag releasing the secured upper portion of the sheets and top portion of the bag from the upper edge portion of the receptacle; and gathering the upper portion of the sheets and top portion of the bag.

In the illustrated embodiment, at least a portion of the sets of sheets overlie a pair of intersecting portions of the sidewall.

The sheets may further define lower portions turned to overlie the bottom portion of the bag.

The method may include the step of installing a bottom set of stacked paper sheets in overlying relationship to the bottom portion of the bag.

The bottom set of stacked sheets may further overlie the lower turned portions of the sidewall lining sheets.

The securing step may comprise a step of gripping substantially the entire turned overlying upper portion of the stacked sheets and top portion of the bag about the upper edge portion of the receptacle.

A portion of the turned upper portion of the stacked sheets and the bag may be clamped against the sidewall of the receptacle below the top of the upper edge portion thereof.

Upon completion of the compacting operation and the gathering of the top portion of the bag, the gathered top portion and the stacked sheet portions therein may be secured for facilitated disposal of the bagged compacted refuse.

The bag is adapted to be capable of carrying the compacted refuse as by lifting the same by the gathered portion thereof.

The sets of paper sheets within the bag may be overlapped at different portions of the bag for providing reinforcements at preselected positions during the compacting operation.

The thickness of the stacked sheets is preferably substantially greater than the thickness of the flexible bag.

In the illustrated embodiment, the sheets are formed of a paper material, such as newsprint, for effectively minimum cost.

Thus, the method of the present invention is extremely simple and economical while yet providing a highly improved and low cost refuse compaction wherein relatively low cost, thin-walled bags may be utilized for enclosing and disposing of the compacted refuse.

BRIEF DESCRIPTION OF THE DRAWING

Other features and advantages of the invention will be apparent from the following description taken in connection with the accompanying drawing wherein:

FIG. 1 is a perspective view of a trash compactor utilizing a reusable protective sheath to protect the thin-walled bag, illustrating the prior art;

FIG. 2 is a fragmentary perspective view illustrating the installation of the plastic bag in the refuse compactor drawer;

FIG. 3 is a fragmentary perspective view illustrating a first step in the provision of the protective stacked sheet liner for the bag;

FIG. 4 is a fragmentary perspective view with portions broken away illustrating a second step therein;

FIG. 5 is a fragmentary perspective view with portions broken away illustrating a further step therein;

FIG. 6 is a fragmentary top plan view of the drawer with the liner partially installed therein illustrating a still further step of the method;

FIG. 7 is a fragmentary top plan view illustrating a still further step wherein the bottom wall of the bag is provided with an overlying stack of sheets;

FIG. 8 is a fragmentary perspective view illustrating a still further step of the method wherein a collar is provided for securing the upper portions of the bag and liner sheets to the upper edge of the drawer to complete the installation of the bag and protective liner for subsequent compaction of refuse therein;

FIG. 9 is a fragmentary perspective view illustrating the step of removing the securing collar to permit removal of the bagged compacted refuse upon completion of the compaction operation; and FIG. 10 is a fragmentary perspective view illustrating the step of gathering and securing the upper end of the bag about the enclosed compacted refuse and stacked sheet liner to permit subsequent lifting of the closed bag from the refuse compactor drawer for suitable disposal.

DESCRIPTION OF THE PREFERRED EMBODIMENT

In the exemplary embodiment of the invention as disclosed in the drawing, a refuse compactor generally designated 10 is shown to comprise a conventional refuse compactor having a compacting drawer 11 movably mounted within a cabinet 12 so as to be selectively disposable within the cabinet in a refuse compacting disposition and forwardly of the cabinet in a refuse receiving position as shown in FIG. 1. The drawer is provided with a suitable handle 13 for effecting the desired positioning thereof.

In carrying out the compacting operation, it is desirable to utilize a disposable bag, such as bag 14, to contain the compacted refuse and permit facilitated disposal thereof. Many such commercially available bags, however, are relatively fragile and may be easily torn as by sharp objects in the refuse being compacted and it has thus been conventional, as shown in FIG. 1, to utilize a protective sheath, such as sheath 15, which is inserted within the bag so as to serve as a protective liner during the compacting operation thereby preventing cutting and tearing of the bag 14. The sheath is adapted to be readily inserted into the liner when the liner is installed in the drawer 11 with the top portion 16 of the bag turned over the upper edge portion of the drawer and secured in the turned disposition by suitable clamps 17 carried on the drawer.

The present invention eliminates the need for the reusable liner 15 of the prior art for protecting the relatively tear-susceptible bag 14 during the compacting operation. More specifically, as shown in FIGS. 3–7, the invention comprehends the installation of a plurality of sets of stacked paper sheets 18 in lining relationship to the interior of the bag 14. As shown in FIG. 4, the sheets may be installed in the bag in facial engagement with the inner surface of the bag with an upper portion 19 of the stacked sheets being turned over the top portion 16 of the bag which, as discussed above, is turned over the top edge portion of the drawer.

More specifically, the drawer may comprise an upwardly open, parallelepiped drawer wherein the upright sidewall 20 includes a front wall 21, a left sidewall 22, a right sidewall 23, and a rear wall 24.

As shown in FIG. 4, a first set 25 of stacked sheets 18 is arranged to overlie the bag along left sidewall 22 and a second set of sheets 26 is arranged to overlie the bag adjacent right sidewall 23. The upper portions 19 of each of the sets of sheets 25 and 26 is turned over the upper edge of the drawer so as to be clamped by the clamp 17 in the desired bag-lining arrangement.

As further shown in FIG. 4, the lower end 27 of each of the sets of sheets 25 and 26 is inturned to overlie the bottom wall 28 of the drawer.

As illustrated in FIGS. 5 and 6, subsequent to the installation of the sets of sheets 25 and 26, a third set of sheets 29 is installed in overlying relationship to the bag adjacent the front wall 21 of the drawer and a fourth set of stacked sheets 30 is disposed in overlying relationship to the bag adjacent the rear wall 24 of the drawer. As shown, each of these sets of sheets 29 and 30 may be folded at the vertical corners of the drawer so as to overlap the sheet sets 25 and 26 at the corners and thereby provide a reinforced corner arrangement of the bag liner configuration. The upper portions of the sets of sheets 29 and 30 are turned over the upper edge portion of the front wall 21 and rear wall 24, as illustrated in FIG. 5, and the turned portions of the sheet sets 29 and 30 overlapping the sheet sets 25 and 26 are similarly provided with upper portions turned over the turned-over upper portions 19 of the sheet sets 25 and 26.

As best seen in FIG. 6, the lower ends 31 of the sheet sets 29 and 30 are inturned to overlie the bottom wall 28 of the drawer and also to overlie the inturned portions 27 of the sidewall sheet sets 25 and 26.

Referring now to FIG. 7, completion of the installation of the stacked sheet liner may be effected by installing a set of sheets 32 across the bottom of the drawer in overlying relationship to the inturned lower portions 27 and 31 of the sidewall sheets.

To secure the protective sheets in lining association with the bag 14, a retaining collar 33 is fitted over the turned over sheet portions 19 of the sheet sets 25, 26, 29 and 30, as shown in FIG. 8. The collar clamps the sheets about the upper edge portion of the drawer to effectively positively retain the sheets in lining association with the bag during the compacting operation, thereby effectively preventing tearing and damage to the bag by the material being compacted during such operation.

Upon completion of the compacting operation, which may include a series of successive compactions of refuse introduced seriatum into the lined bag with the drawer 11, the accumulated compacted refuse may then be removed from the drawer for suitable disposal by first removing the clamping collar 33, as illustrated in FIG. 9. The turned-over upper portion 19 of the sheet set is then brought into overlying relationship with the compacted refuse by suitable release of the sheet sets 25 and 26 from the clamp 17. The upper portion 16 of the bag 14, upon release from the clamp 17, may be gathered, as shown in FIG. 10, and the gathered portion 16 thereof may be secured by suitable securing means, such as securing element 34. The bagged, compacted refuse may then be removed from the drawer in the conventional manner to be disposed of as desired. A new bag may be installed in the drawer and lined in a similar manner as described above for effecting a subsequent compacting operation in the apparatus 10 as desired.

Thus, the invention comprehends an improved method of bagging refuse in a refuse compactor wherein a disposable sheath is provided for protecting the relatively tearable bag during the compacting operation. The sheath is arranged to be disposed with the compacted refuse within the enclosing bag for disposal with the refuse. Thus, it is unnecessary to clean the sheath from time to time as is required with the reusable sheaths of the prior art. Further, as relatively low cost newsprint or the like may be utilized as the sheet material, the cost of the improved disposable sheath is negligible so that the sheath is economically disposable.

Further, the use of the user-installed disposable sheath structure permits the user to coordinate the sheath thickness with the type of refuse normally compacted by the specific user. Thus, where it is contemplated by the user that refuse to be compacted will be primarily nontearing material, such as wastepaper, soft garbage, etc., the thickness of the sheet stacks may be minimal. Alternatively, where sharp tear-causing refuse, such as bottles and cans, are to be compacted, the user may provide a relatively thicker set of stacked sheets in the sheath construction. Thus, the sheath structure of the present invention is readily adaptable for different refuse conditions.

The foregoing disclosure of specific embodiments is illustrative of the broad inventive concepts comprehended by the invention.

Having described the invention, the embodiments of the invention in which an exclusive property or privilege is claimed are defined as follows:

1. The method of bagging refuse in a refuse compactor having an upwardly opening compaction receptacle defining an upper edge portion, an upright sidewall, and a bottom wall, comprising the steps of:

installing an upwardly opening bag in the receptacle with a bottom portion superposed on said receptacle bottom wall, a sidewall portion juxtaposed to said receptacle sidewall, and a top portion turned over said receptacle upper edge;

installing a plurality of sets of stacked paper sheets in lining relationship to said bag with the upper portions of said sheets turned over said turned-over top portion of the bag;

securing the overlying upper portions of the sheets and top portion of the bag to the upper edge portion of the receptacle;

depositing and compacting refuse in the sheet-lined bag;

releasing the secured upper portion of the sheets and top portion of the bag from the upper edge portion of the receptacle; and gathering the upper portions of the sheets and top portion of the bag.

2. The method of bagging refuse in a refuse compactor of claim 1 wherein said receptacle sidewall defines a plurality of planar intersecting walls, at least a portion of the sets of sheets overlying an intersecting pair of said walls.

3. The method of bagging refuse in a refuse compactor of claim 1 wherein said sheets define lower portions turned to overlie the bottom portion of the bag.

4. The method of bagging refuse in a refuse compactor of claim 1 wherein said sheets define lower portions turned to overlie the bottom portion of the bag and further including the step of installing a bottom set of stacked paper sheets in overlying relationship to said bottom portion of the bag.

5. The method of bagging refuse in a refuse compactor of claim 1 wherein said sheets define lower portions turned to overlie the bottom portion of the bag and further including the step of installing a bottom set of stacked paper sheets in overlying relationship to said bottom portion of the bag and said lower turned portions of the first named sets of sheets.

6. The method of bagging refuse in a refuse compactor of claim 1 wherein said securing step comprises a step of gripping substantially the entire turned overlying upper portions of the sheets and top portion of the bag about the upper edge portion of the receptacle.

7. The method of bagging refuse in a refuse compactor of claim 1 further including the step of clamping a portion of said turned upper portions of said sheets and said bag against the sidewall of the receptacle below the top of said upper edge portion of the receptacle.

8. The method of bagging refuse in a refuse compactor of claim 1 further including the step of securing the gathered upper portions of the sheets and top portion of the bag.

9. The method of bagging refuse in a refuse compactor of claim 1 further including the step of lifting the bag from the receptacle by the gathered portion thereof.

10. The method of bagging refuse in a refuse compactor of claim 1 wherein the sets of paper sheets are overlapped at different portions of the bag.

* * * * *